US010747250B2

(12) United States Patent
Lee et al.

(10) Patent No.: US 10,747,250 B2
(45) Date of Patent: Aug. 18, 2020

(54) INTEGRATED CIRCUIT WITH ADAPTABILITY TO A PROCESS-VOLTAGE-TEMPERATURE (PVT) VARIATION

(71) Applicant: SAMSUNG ELECTRONICS CO., LTD., Suwon-si, Gyeonggi-Do (KR)

(72) Inventors: Seok-won Lee, Hwaseong-si (KR); Nam-seog Kim, Seoul (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 16/453,149

(22) Filed: Jun. 26, 2019

(65) Prior Publication Data

US 2020/0012301 A1 Jan. 9, 2020

(30) Foreign Application Priority Data

Jul. 4, 2018 (KR) ..... 10-2018-0077893

(51) Int. Cl.
*G05F 1/575* (2006.01)

(52) U.S. Cl.
CPC ..... *G05F 1/575* (2013.01)

(58) Field of Classification Search
None
See application file for complete search history.

(56) References Cited

U.S. PATENT DOCUMENTS 5,565,752 A * 10/1996 Jansen ..... H02K 17/165 310/169
6,285,246 B1 9/2001 Basu
7,723,968 B2 5/2010 Okuyama et al.
8,624,568 B2 1/2014 Ivanov et al.
9,552,006 B1 * 1/2017 Gorecki ..... G05F 1/565
2014/0292301 A1 10/2014 Lee et al.
2015/0022177 A1 1/2015 Petrovic et al.
2015/0286232 A1 10/2015 Parikh
2015/0309518 A1 10/2015 Nagda et al.
2015/0346750 A1 12/2015 Bhattad
2016/0065220 A1 * 3/2016 Rana ..... H03K 3/0315 331/1 R

FOREIGN PATENT DOCUMENTS

JP 2015-201170 11/2015
KR 10-2016-0137803 12/2016
KR 10-1796769 11/2017

OTHER PUBLICATIONS

Chin-Wei Yao et al., "A 14-nm 0.14-psrms Fractional-N Digital PLL With a 0.2-ps Resolution ADC-Assisted Coarse/Fine-Conversion Chopping TDC and TDC Nonlinearity Calibration", IEEE Journal of Solid-State Circuits, vol. 52, No. 12, Dec. 2017, pp. 3446-3457.

* cited by examiner

*Primary Examiner* — Cassandra F Cox
(74) *Attorney, Agent, or Firm* — F. Chau & Associates, LLC

(57) ABSTRACT

An integrated circuit including: an oscillator configured to generate an oscillating voltage with a predetermined oscillation frequency in an oscillation period; a voltage regulator configured to generate an output voltage for driving the oscillator and provide the output voltage to the oscillator; and a current injection circuit configured to provide an oscillation current to the oscillator, in response to an oscillation enable signal in the oscillation period.

20 Claims, 15 Drawing Sheets

INTEGRATED CIRCUIT WITH ADAPTABILITY TO A PROCESS-VOLTAGE-TEMPERATURE (PVT) VARIATION

CROSS-REFERENCE TO RELATED APPLICATION

This application claims priority under 35 § 119 to Korean Patent Application No. 10-2018-0077893, filed on Jul. 4, 2018, in the Korean Intellectual Property Office, the disclosure of which is incorporated by reference herein in its entirety.

TECHNICAL FIELD

The inventive concept relates to an integrated circuit, and more particularly, to an integrated circuit adaptable to process-voltage-temperature (PVT) variations.

DISCUSSION OF RELATED ART

A phase locked loop (PLL) is a circuit for outputting a voltage that oscillates at a constant frequency equal to a predetermined reference frequency. The PLL fixes a frequency in such a way that a transmitted signal is continuously changed until the transmitted signal matches the reference frequency. The PLL is widely used in digital signal transmission and communication and digital and analog electronic circuit systems.

For example, in a radio frequency (RF) system, a PLL is used to prevent the frequency of a frequency source from shaking. As another example, an all digital PLL (ADPLL), which uses only logic circuits, may convert a phase difference between a reference frequency and a feedback frequency into a digital signal by using a time-digital converter. In this case, however, when an oscillator in a time-digital converter has a characteristic sensitive to the PVT, an operational reliability of the PLL may be reduced.

SUMMARY

According to an exemplary embodiment of the inventive concept, there is provided an integrated circuit including: an oscillator configured to generate an oscillating voltage with a predetermined oscillation frequency in an oscillation period; a voltage regulator configured to generate an output voltage for driving the oscillator and provide the output voltage to the oscillator; and a current injection circuit configured to provide an oscillation current to the oscillator, in response to an oscillation enable signal in the oscillation period.

According to an exemplary embodiment of the inventive concept, there is provided an integrated circuit including: an oscillator configured to generate an oscillation voltage in an oscillation period; a voltage regulator configured to drive the oscillator by providing an output voltage to the oscillator via an output terminal of the voltage regulator; and a current injection circuit connected to the oscillator and the output terminal of the voltage regulator, the current injection circuit being configured to output an oscillation current to the oscillator in the oscillation period, wherein the voltage regulator comprises: an operational amplifier (OP AMP) configured to amplify a difference between a reference voltage input to a first terminal of the OP AMP and a feedback voltage input to a second terminal of the OP AMP; and a reference voltage generator configured to generate the reference voltage by injecting a current to a transistor and a resistor, the reference voltage generator being connected to the first terminal of the OP AMP.

According to an exemplary embodiment of the inventive concept, there is provided an integrated circuit configured to supply a constant voltage and a constant current to components connected to each other in an operation period, the integrated circuit comprising: a voltage regulator configured to output a constant direct current output voltage via an output node connected to the components; and a current injection circuit including a first transistor which is configured to receive a gate voltage signal from an auxiliary voltage regulating circuit, generate an injection current, and output the injection current to the components in the operation period.

BRIEF DESCRIPTION OF THE DRAWINGS

The above and other features of the inventive concept will be more clearly understood by describing in detail exemplary embodiments thereof with reference to the accompanying drawings in which.

DETAILED DESCRIPTION OF THE EMBODIMENTS

Hereinafter, exemplary embodiments of the inventive concept are described in detail with reference to the accompanying drawings.

Figure 1:
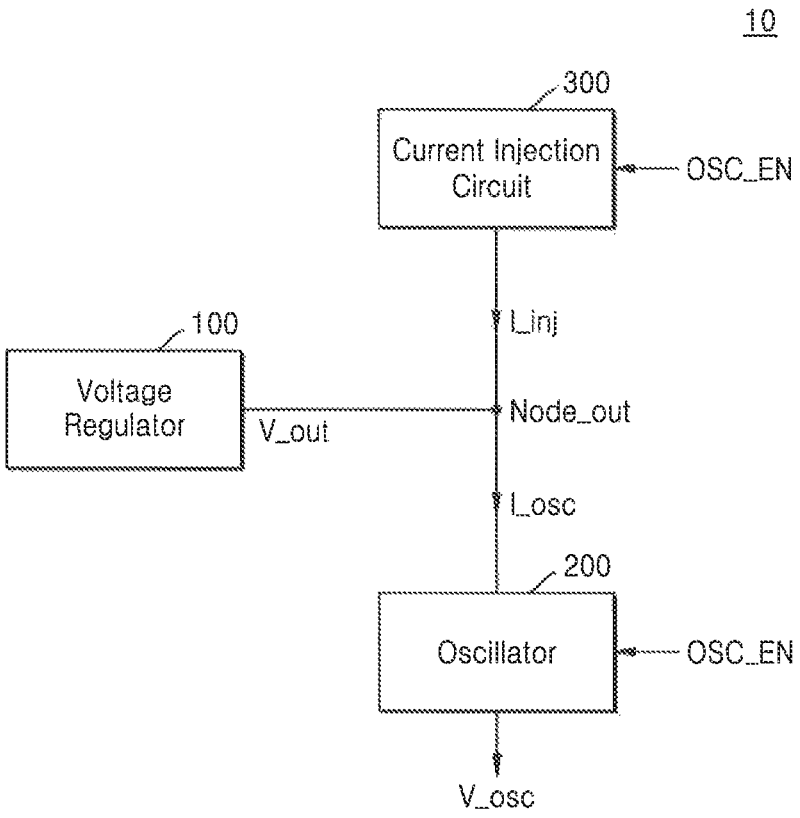
FIG. 1 is a diagram of an integrated circuit according to an exemplary embodiment of the inventive concept.

FIG. 1 is a diagram of an integrated circuit 10 according to an exemplary embodiment of the inventive concept. The integrated circuit 10 may include a voltage regulator 100, an oscillator 200, and a current injection circuit 300. The integrated circuit 10 may be implemented as a single chip; however, at least one component of the integrated circuit 10 may be implemented as a separate chip. In an exemplary embodiment of the inventive concept, the integrated circuit 10 may be included in a conversion circuit such as a time-to-digital converter (TDC). In addition, in an exemplary embodiment of the inventive concept, the integrated circuit 10 may be included in a phase locked loop (PLL) included in a conversion circuit such as the TDC. For example, the integrated circuit 10 be included in an all digital (ADPLL).

The voltage regulator 100 may be connected to the oscillator 200 via an output node Node_out and provide an output voltage V_out to the oscillator 200 via the output node Node_out. In other words, the voltage regulator 100 may generate the output voltage V_out for use by the oscillator 200 by regulating a voltage in the voltage regulator 100. In an exemplary embodiment of the inventive concept, the output voltage V_out may be a constant direct current (DC) voltage. In an exemplary embodiment of the inventive concept, the voltage regulator 100 may be a low drop-out (LDO) regulator. The voltage regulator 100 according to an exemplary embodiment of the inventive concept is described in more detail with reference to FIGS. 5 through 6B.

The oscillator 200 may generate an oscillation voltage V_osc by using the output voltage V_out provided from the voltage regulator 100 via the output node Node_out based on a predetermined oscillation frequency in an oscillation period. For example, in the oscillation period, the oscillator 200 may generate the oscillation voltage V_osc to be constant so that a frequency of the oscillation voltage V_osc is kept equal to the predetermined oscillation frequency. The oscillation period may be an operation period in which the oscillator 200 generates the oscillation voltage V_osc. The oscillator 200 may enter the oscillation period based on an oscillation enable signal OSC_EN. For example, when the oscillation enable signal OSC_EN has a first logic level (e.g., '1') the oscillator 200 may generate the oscillation voltage V_osc by entering the oscillation period. In an exemplary embodiment of the inventive concept, the oscillator 200 may be a ring oscillator including a plurality of inverters connected to each other in series.

In the oscillation period, an oscillation current I_osc may be output to the oscillator 200. The current injection circuit 300 may output an injection current I_inj to the output node Node_out in the oscillation period, and the oscillator 200 may receive the injection current I_inj supplied from the current injection circuit 300 as the oscillation current I_osc. In the oscillation period, the oscillator 200 may keep the output voltage V_out constant by operating according to the oscillation current I_osc provided from the current injection circuit 300. It is to be understood that the oscillator 200 is separate from the voltage regulator 100.

The current injection circuit 300 may, in the oscillation period, inject the injection current I_inj into the oscillator 200. The oscillation current lose is generated when the oscillator 200 outputs the injection current I_inj to an electric path connected to the output node Node_out. In an exemplary embodiment of the inventive concept, the injection current I_inj may be equal in magnitude to the oscillation current I_osc.

In an exemplary embodiment of the inventive concept, the current injection circuit 300 may be connected to a gate of a pass transistor of the voltage regulator 100 to form a current. The above embodiment is described in more detail with reference to FIG. 7.

In addition, in an exemplary embodiment of the inventive concept, the current injection circuit 300 may include an imitation voltage regulation circuit including components of the voltage regulator 100. The above embodiment is described in more detail with reference to FIG. 9.

Figure 2A:
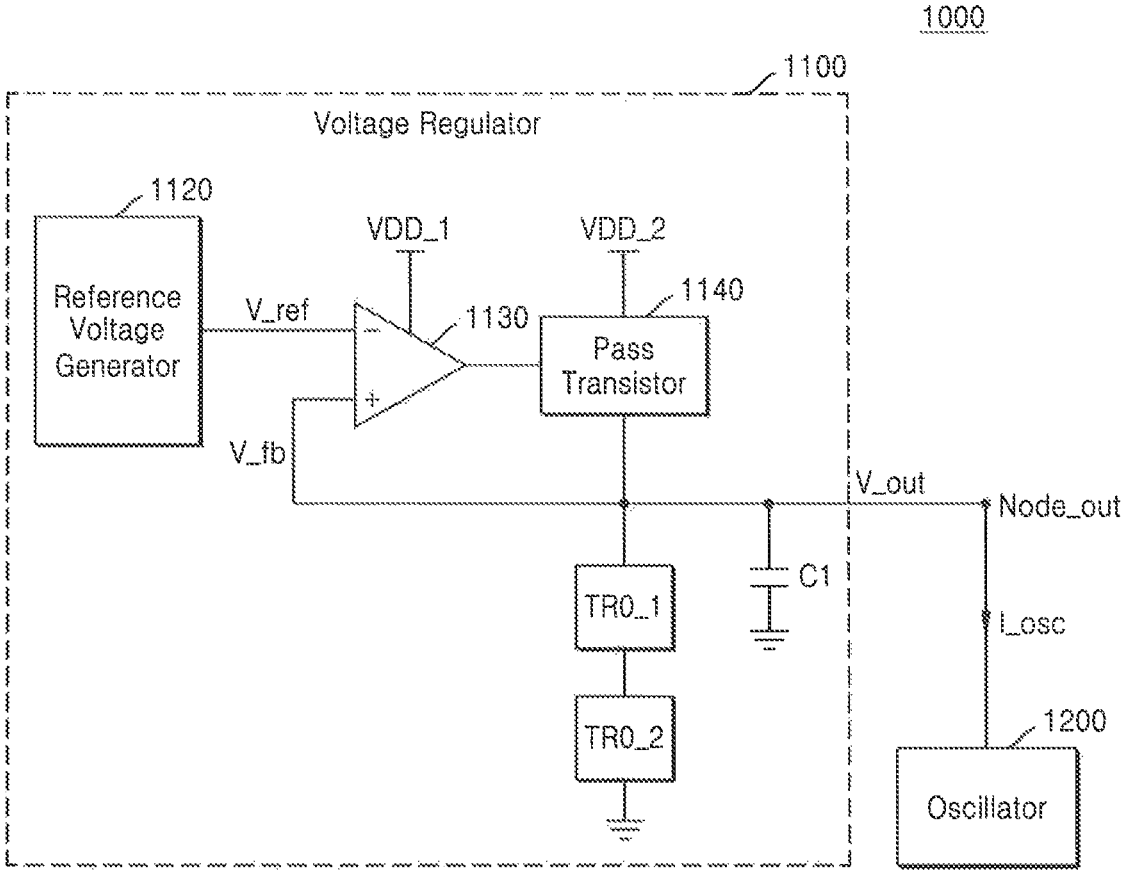
FIG. 2A is a diagram of an integrated circuit.

FIG. 2A is a diagram of an integrated circuit 1000. The integrated circuit 1000 may include a voltage regulator 1100 and an oscillator 1200.

The voltage regulator 1100 may include a reference voltage generator 1120, an operational amplifier 1130, a pass transistor 1140, a first transistor (TR0_1), and a second transistor (TR0_2). The voltage regulator 1100 may further include a capacitor C1 connected between the output node Node_out and a ground node.

The reference voltage generator 1120 may generate a reference voltage V_ref and provide the generated reference voltage V_ref as an input to a first terminal of the operational amplifier 1130. For example, the reference voltage generator 1120 may provide the reference voltage V_ref as an input to a negative terminal (−) of the operational amplifier 1130.

A feedback voltage V_fb may be input to a second terminal of the operational amplifier 1130. The feedback voltage V_fb may be the output voltage V_out. In other words, the second terminal of the operational amplifier 1130 may be connected to the output node Node_out. For example, a positive terminal (+) of the operational amplifier 1130 may be connected to the output node Node_out and receive the output voltage V_out as an input. An output terminal of the operational amplifier 1130 may be connected to a gate of the pass transistor 1140, and an output signal of the operational amplifier 1130 may drive the pass transistor 1140.

The pass transistor 1140 may be an n-type metal oxide semiconductor field effect transistor (MOSFET) or a p-type MOSFET. The pass transistor 1140 may be driven by a driving voltage VDD_2. When the pass transistor 1140 is an n-type MOSFET, a potential level of the output terminal of the operational amplifier 1130 may have a first value that is a sum of the output voltage V_out and a gate-source voltage of the pass transistor 1140. As a consequence, a driving voltage VDD_1 of the operational amplifier 1130 may be required to have a voltage value that is equal to or greater than the first value. When the voltage regulator 1100 is an LDO regulator, the driving voltage VDD_1 of the operational amplifier 1130 may only have a voltage value that is equal to or less than a threshold value. In this case, the pass transistor 1140 may be a p-type MOSFET.

When the pass transistor 1140 is a p-type MOSFET, the capacitor C1 may be connected between the output node Node_out and the ground node for operation stability of the voltage regulator 1100. In the oscillation period, when the oscillation current I_osc is provided to the oscillator 1200, a portion of the charge stored in the capacitor C1 may be discharged. When a portion of the charge stored in the capacitor C1 is discharged in the oscillation period, a value of the output voltage V_out may gradually decrease. When the output voltage V_out is changed in the oscillation period, the oscillator 1200 may fail to generate the oscillation voltage V_osc having a constant frequency and, as a result, the operating reliability of the oscillator 1200 and the integrated circuit 1000 including the oscillator 1200 may be reduced. A change in the output voltage V_out due to a discharge of the capacitor C1 in the oscillation period is described in more detail with reference to FIG. 2B.

Figure 2B:
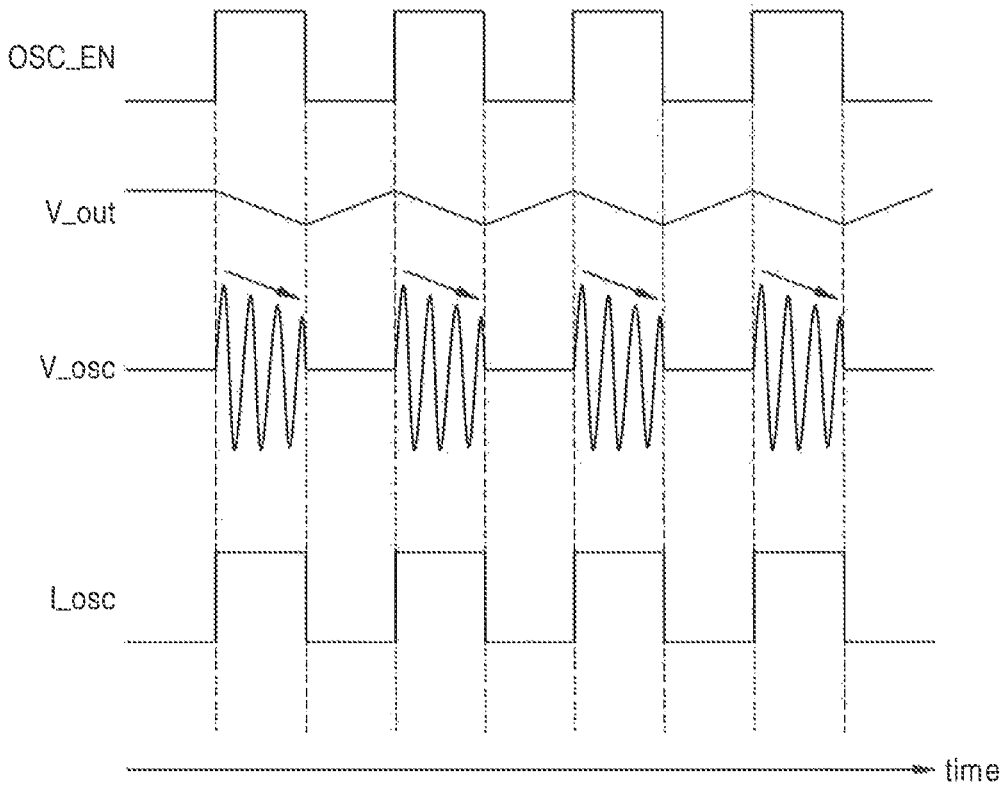
FIG. 2B illustrates tinting diagrams of voltages and current due to an integrated circuit of FIG. 2A.

FIG. 2B illustrates timing diagrams of voltages and current due to the integrated circuit 1000 of FIG. 2A. FIG. 2B is described together with the integrated circuit 1000 of FIG. 2A.

A time period in which the oscillation enable signal OSC_EN has the first logic level may be the oscillation period of the oscillator 1200. As a non-limiting example, the first logic level may be logic high '1'.

In the oscillation period in which the oscillation enable signal OSC_EN has the first logic level, the oscillation current I_osc required by the oscillator 1200 may have a constant value. During the oscillation period, since the oscillation current I_osc is maintained constant, the capacitor C1 connected to the output node Node_out of the voltage regulator 1100 may be partially discharged. As a result, the output voltage V_out may be reduced. As the output voltage V_out decreases, a voltage level of the oscillating voltage V_osc may also decrease, and thus, a frequency of the oscillating voltage V_osc may also be changed. When the oscillation voltage V_osc is not maintained at a constant frequency and constant level, the reliability of the integrated circuit 1000 may be reduced.

To increase the reliability of an integrated circuit, an integrated circuit according to an exemplary embodiment of the inventive concept may further include a current injection circuit for injecting current. For example, referring to FIG. 1, the integrated circuit 10 may further include the current injection circuit 300 that provides the injection current I_inj to the oscillator 200.

Figure 3:
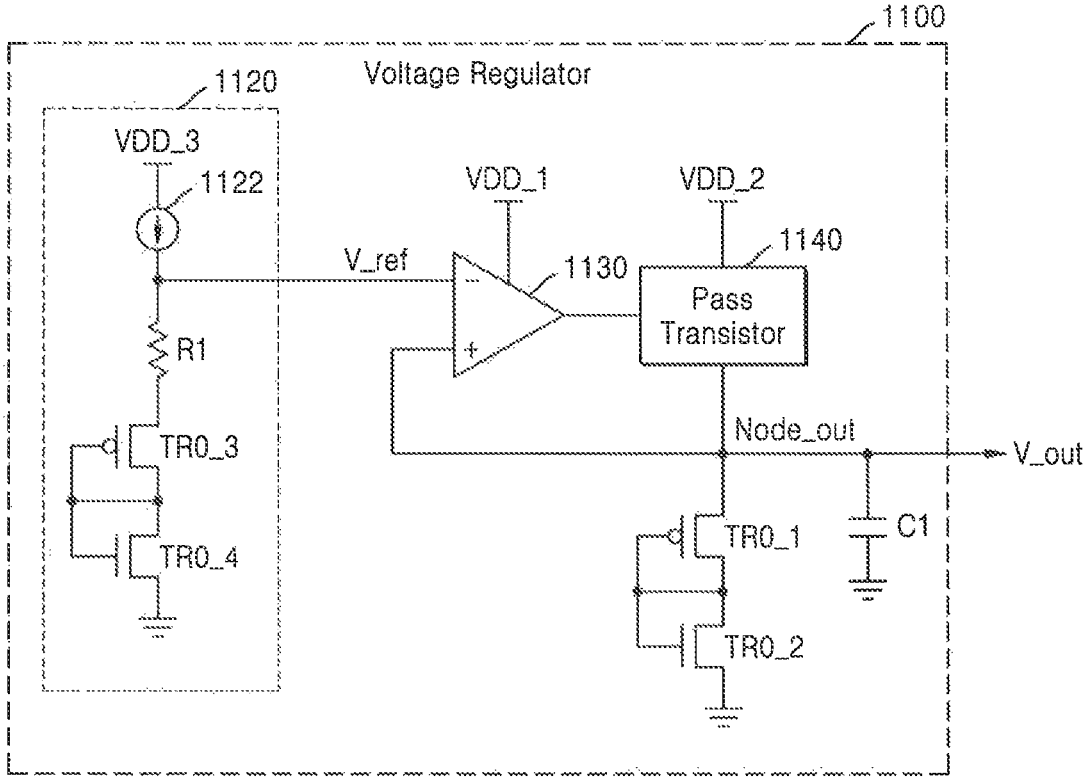
FIG. 3 is a diagram of a voltage regulator.

FIG. 3 is a diagram of a voltage regulator 1100. In particular, FIG. 3 is provided to explain the operation of a general voltage regulator. The voltage regulator 1100 may include the reference voltage generator 1120, the operational amplifier 1130, the pass transistor 1140, the first transistor TR0_1, the second transistor TR0_2, and the capacitor C1.

The reference voltage generator 1120 may include a current source 1122, a resistor R1, a third transistor TR0_3, and a fourth transistor TR0_4. Gates and drains of the third transistor TR0_3 and the fourth transistor TR0_4 may be electrically connected to each other. A connection method in which gates and drains of transistors are electrically connected to each other may be referred to as a diode connection. In other words, the third transistor TR0_3 and the fourth transistor TR0_4 may be diode connected. Current generated by the current source 1122 may flow through the resistor R1 the third transistor TR0_3, and the fourth transistor TR0_4, which are connected in series between the first terminal of the operational amplifier 1130 and the ground node. The reference voltage V_ref may be formed by a voltage drop formed by the current flowing through the resistor R1, the third transistor TR0_3, and the fourth transistor TR0_4, and the reference voltage V_ref may be input to the first terminal of the operational amplifier 1130.

The operational amplifier 1130 may amplify a difference between the reference voltage V_ref input to the first terminal thereof and the feedback voltage V_fb input to the second terminal thereof, and an output of the operational amplifier 1130 may be input to the gate of the pass transistor 1140 to drive the pass transistor 1140. The second terminal of the operational amplifier 1130 may be connected to the output node Node_out of the voltage regulator 1100, and the feedback voltage V_fb, which is provided to the second terminal of the operational amplifier 1130, may be the output voltage V_out of the voltage regulator 1100.

As will be described with reference to FIG. 4, transistors may have randomly different characteristics depending on process variation of a manufacturing process. In the voltage regulator 1100 of FIG. 3, the third transistor TR0_3 may be a p-type MOSFET, and the fourth transistor TR0_4 may be an n-type MOSFET. Since the reference voltage V_ref is determined based on a voltage drop due to both the third transistor TR0_3, which is a p-type MOSFET, and the fourth transistor TR0_4, which is an n-type MOSFET, the process variation may be tracked. However, since the voltage level of the reference voltage V_ref is determined by a voltage drop due to the resistor R1, the third transistor TR0_3, and the fourth transistor TR0_4, the voltage level of the reference voltage V_ref may be very high. In addition, when the voltage level of the reference voltage V_ref has a considerably high value, the value of the driving voltage VDD_1 of the operational amplifier 1130 may need to be large. In other words, due to a size limitation of a value of the driving voltage VDD_1 of the operational amplifier 1130, the voltage generator 1100 may not be implemented as an LDO regulator.

Figure 4:
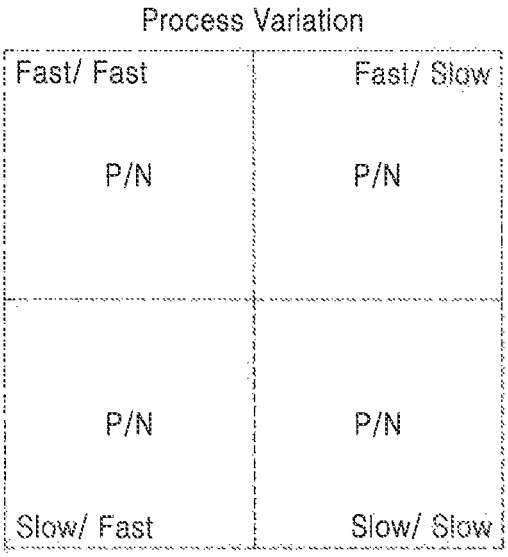
FIG. 4 illustrates characteristics of transistors according to a process variation, according to an exemplary embodiment of the inventive concept.

FIG. 4 illustrates characteristics of transistors according to a process variation, according to an exemplary embodiment of the inventive concept. Transistors may have different characteristics depending on the process variation of a manufacturing process. FIG. 4 illustrates changes in characteristics of a p-type MOSFET and an n-type MOSFET.

Each of the p-type MOSFET and the n-type MOSFET may have a fast characteristic, a typical characteristic, and a slow characteristic according to the process variation. Under the same driving voltage, a transistor with the fast characteristic may form more current than a transistor with the typical characteristic, and a transistor with the slow characteristic may form less current than a transistor with the typical characteristic.

In general, an integrated circuit may include at least one p-type MOSFET and at least one n-type MOSFET. Thus, the characteristics of the transistors according to the process variation may be classified into four types. A first type may be a type in which both the p-type MOSFET and the n-type MOSFET have the fast characteristic. An example of this is shown in the upper left quadrant of FIG. 4. A second type may be a type in which the p-type MOSFET has the fast characteristic and the n-type MOSFET has the slow characteristic. An example of this is shown in the upper right quadrant of FIG. 4. A third type may be a type in which the p-type MOSFET has the slow characteristic and the n-type MOSFET has the fast characteristic. An example of this is shown in the lower left quadrant of FIG. 4. A fourth type may be a type in which both the p-type MOSFET and the n-type MOSFET have the slow characteristic. An example of this is shown in the lower right quadrant of FIG. 4. To increase adaptability to a process variation of an integrated circuit, the process variation may be tracked by considering all characteristic differences between the p-type MOSFET and the n-type MOSFET.

Figure 5:
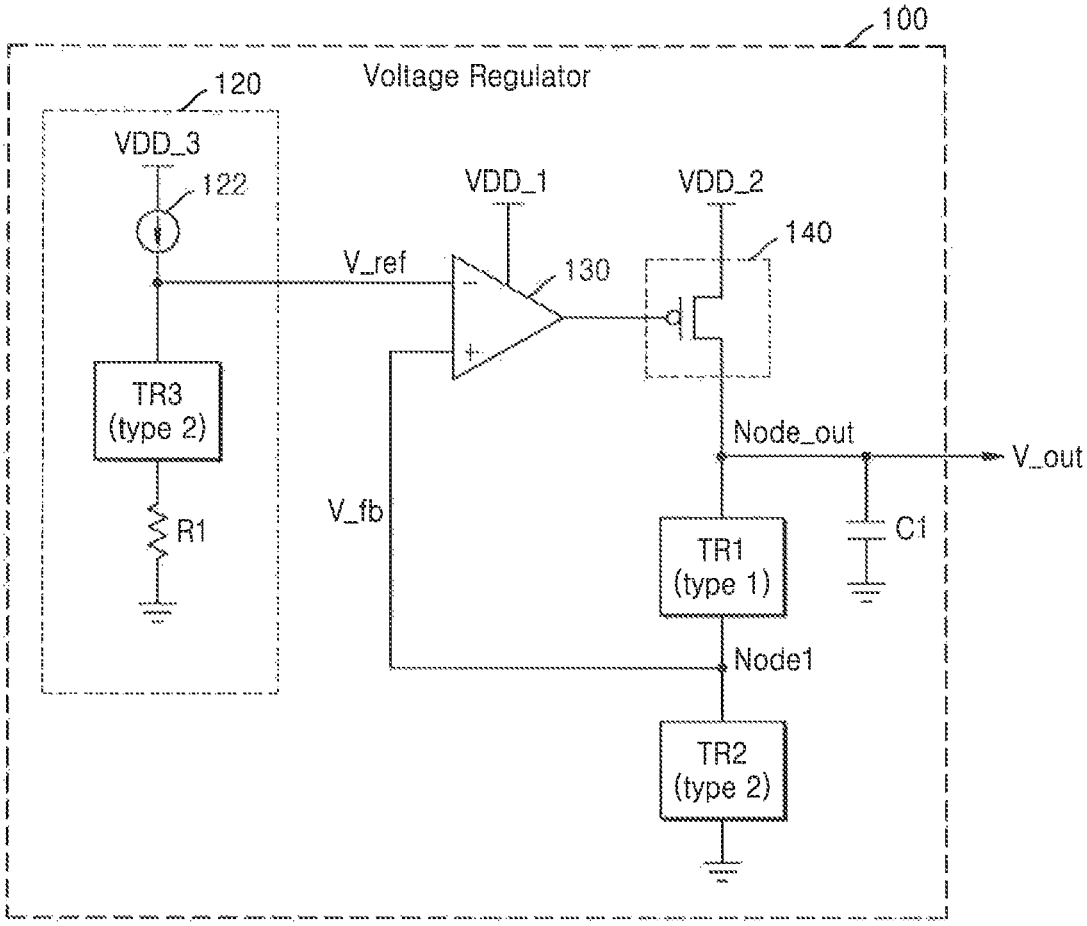
FIG. 5 is a diagram of a voltage regulator according to an exemplary embodiment of the inventive concept.

FIG. 5 is a diagram of a voltage regulator 100 according to an exemplary embodiment of the inventive concept. The voltage regulator 100 may include a reference voltage generator 120, an operational amplifier 130, a pass transistor 140, a first transistor TR1, a second transistor TR2, and further include the capacitor C1.

The reference voltage generator 120 may include a current source 122, a third transistor TR3, and the resistor R1. The reference voltage generator 120 may provide the reference voltage V_ref to a first terminal of the operational amplifier 130. To accomplish this, the third transistor TR3 and the resistor R1 are connected in series between an electrical node connected to the first terminal of the operational amplifier 130 and a ground node. A voltage level of the reference voltage V_ref may be determined by a voltage drop due to the third transistor TR3 and the resistor R1. The reference voltage V_ref may be input to the first terminal of the operational amplifier 130. In an exemplary embodiment of the inventive concept, the third transistor TR3 may be diode connected. In addition, in an exemplary embodiment of the inventive concept, the current source 122 may include a proportional to absolute temperature (PTAT) current source having a characteristic in which current is proportional to an absolute temperature.

In an exemplary embodiment of the inventive concept, the pass transistor 140 may be a p-type MOSFET.

The first transistor TR1 and the second transistor TR2 may be connected in series between the output node Node_out of the voltage regulator 100 and the ground node. An electrical node between the first transistor TR1 and the second transistor TR2 may be referred to as a first node Node1. The first node Node1 may be connected to a second terminal of the operational amplifier 130. In other words, a voltage reflecting a voltage drop due to the output voltage V_out and the first transistor TR1 may be input to the second terminal of the operational amplifier 130 as the feedback voltage V_fb. In an exemplary embodiment of the inventive concept, the first transistor TR1 and the second transistor TR2 may be diode connected.

The third transistor TR3 may be a transistor of a different type from that of the first transistor TR1. The third transistor T3 may be a transistor of the same type as that of the second transistor TR2. In other words, the first transistor TR1 may be a transistor of the first type, while the second transistor TR2 and the third transistor TR3 are transistors of the second type. In an exemplary embodiment of the inventive concept, the first transistor TR1 may be a p-type MOSFET, while the second transistor TR2 and the third transistor TR3 may be n-type MOSFETs. A description of this embodiment is given in detail with reference to FIG. 6A. In addition, in an exemplary embodiment of the inventive concept, the first transistor TR1 may be an n-type MOSFET, while the second transistor TR2 and the third transistor TR3 may be a p-type MOSFET. A description of this embodiment is given in detail with reference to FIG. 6B.

In the voltage regulator 100 according to the present embodiment of the inventive concept, since the voltage level of the reference voltage V_ref is determined by a voltage drop due to the resistor R1 and the third transistor TR3, a magnitude of the driving voltage VDD_1 required by the operational amplifier 130 may be less than that required by the voltage regulator 1100 of FIG. 3. In addition, in an integrated circuit including the voltage regulator 100, there may be the process variation for the p-type MOSFET and the n-type MOSFET as shown in FIG. 4. In the voltage regulator 100 according to the present embodiment of the inventive concept, the process variation of both a transistor of the first type and a transistor of the second type may be tracked. This is done, for example, by tracking the process variation of the transistor of the second type with the reference voltage V_ref and by tracking the process variation of the transistor of the first type with the feedback voltage V_fb.

In other words, the voltage regulator 100 according to the present embodiment of the inventive concept may track the process variation of the p-type MOSFET and the n-type MOSFET by using a low drive voltage, even when the voltage regulator 100 is implemented with the LDO regulator.

Figure 6A:
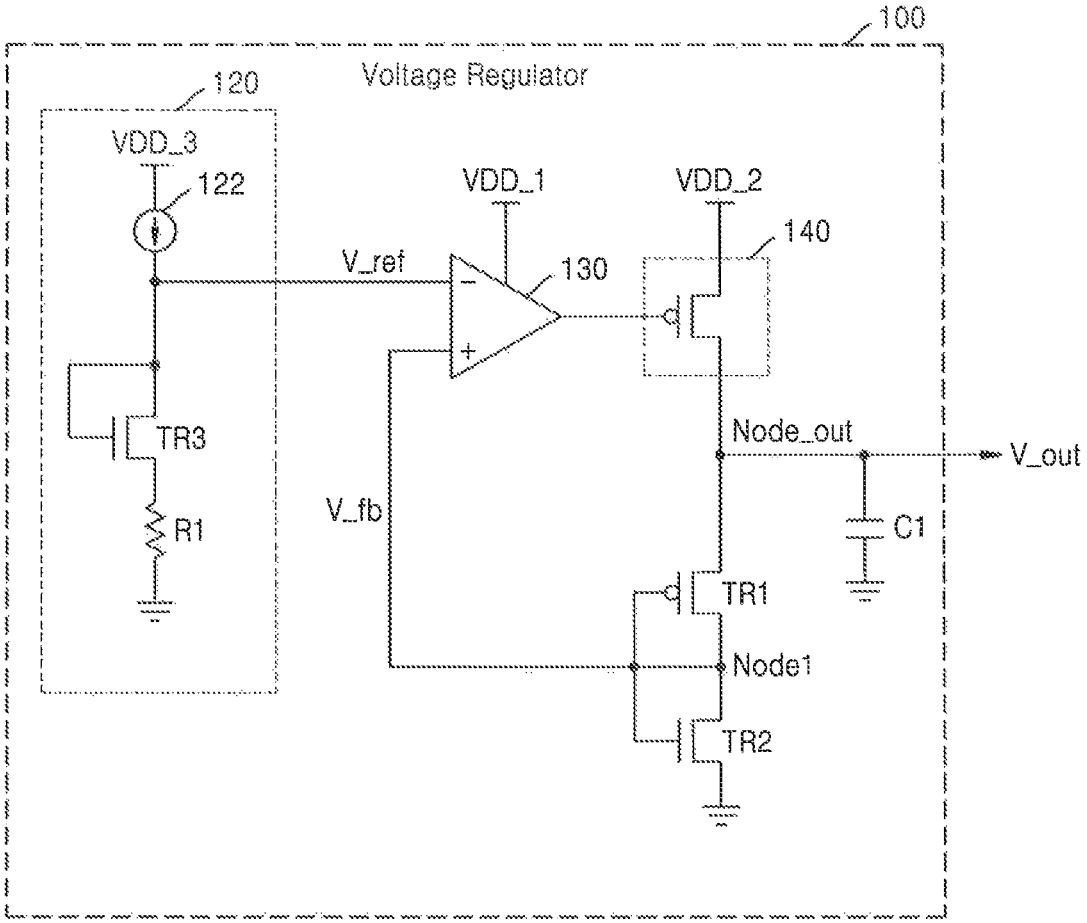
FIG. 6A is a diagram of a voltage regulator according to an exemplary embodiment of the inventive concept.

FIG. 6A is a diagram of the voltage regulator 100 according to an exemplary embodiment of the inventive concept. FIG. 6A illustrates an embodiment in which the first transistor TR1 of the voltage regulator 100 of FIG. 5 is implemented as a p-type MOSFET, and the second transistor TR2 and the third transistor TR3 of the voltage regulator 100 of FIG. 5 are implemented as an n-type MOSFETs. Thus, a duplicate description of elements of the voltage regulator 100 of FIG. 6A, which are the same as those described for FIG. 5, is omitted.

The first transistor TR1 may be a p-type MOSFET, and a gate and a drain thereof may be electrically connected to each other, in other words, the first transistor TR1 may be a diode connected p-type MOSFET that is disposed between the output node Node_out and the first node Node1.

The second transistor TR2 may be an n-type MOSFET, and a gate and a drain thereof may be electrically connected to each other. In other words, the second transistor TR2 may be a diode connected n-type MOSFET that is disposed between the first node Node1 and the ground node.

The third transistor TR3 may be an n-type MOSFET, and a gate and a drain thereof may be electrically connected to each other. In other words, the third transistor TR3 may be a diode connected n-type MOSFET that is disposed between a node connected to the first terminal of the operational amplifier 130 and the resistor R1.

Since the reference voltage V_ref is determined based on the voltage drop of the third transistor TR3, the reference voltage V_ref may track the process variation of the n-type MOSFET. Since the feedback voltage V_fb is determined based on the voltage drop of the first transistor TR1, the feedback voltage V_fb may track the process variation of the p-type MOSFET. As a result, the voltage regulator 100 may track the process variation of both the n-type MOSFET and the p-type MOSFET.

Figure 6B:
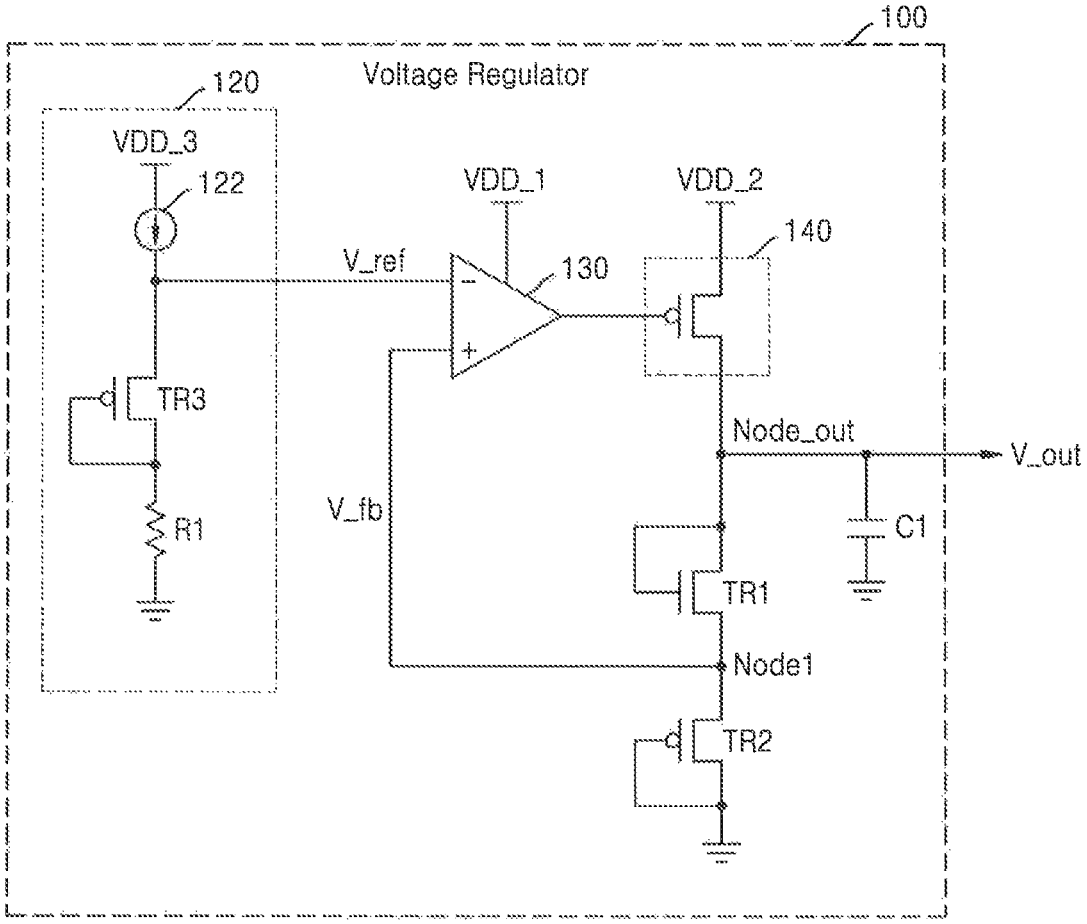
FIG. 6B is a diagram of a voltage regulator according to an exemplary embodiment of the inventive concept.

FIG. 6B is a diagram of the voltage regulator 100 according to an exemplary embodiment of the inventive concept. FIG. 6B illustrates an embodiment in which the first transistor TR1 of the voltage regulator 100 of FIG. 5 is an n-type MOSFET, and the second transistor TR2 and the third transistor TR3 are p-type MOSFETs. Thus, a duplicate description of elements of the voltage regulator 100 of FIG. 6B, which are the same as those described for FIG. 5, is omitted.

The first transistor TR1 may be an n-type MOSFET, and a gate and a drain thereof may be electrically connected to each other. In other words, the first transistor TR1 may be a diode connected n-type MOSFET that is disposed between the output node Node_out and the first node Node1.

The second transistor TR2 may be a p-type MOSFET, and a gate and a drain thereof may be electrically connected to each other. In other words, the second transistor TR2 may be a diode connected p-type MOSFET that is disposed between the first node Node1 and the ground node.

The third transistor TR3 may be a p-type MOSFET, and a gate and a drain thereof may be electrically connected to each other. In other words, the third transistor TR3 may be a diode connected p-type MOSFET that is disposed between a node connected to the first terminal of the operational amplifier 130 and the resistor R1.

Since the reference voltage V_ref is determined based on the voltage drop of the third transistor TR3, the reference voltage V_ref may track the process variation of the p-type MOSFET. Since the feedback voltage V_fb is determined based on the voltage drop of the first transistor TR1, the feedback voltage V_fb may track the process variation of the n-type MOSFET. As a result, the voltage regulator 100 may track the process variation of both the n-type MOSFET and the p-type MOSFET.

Figure 7:
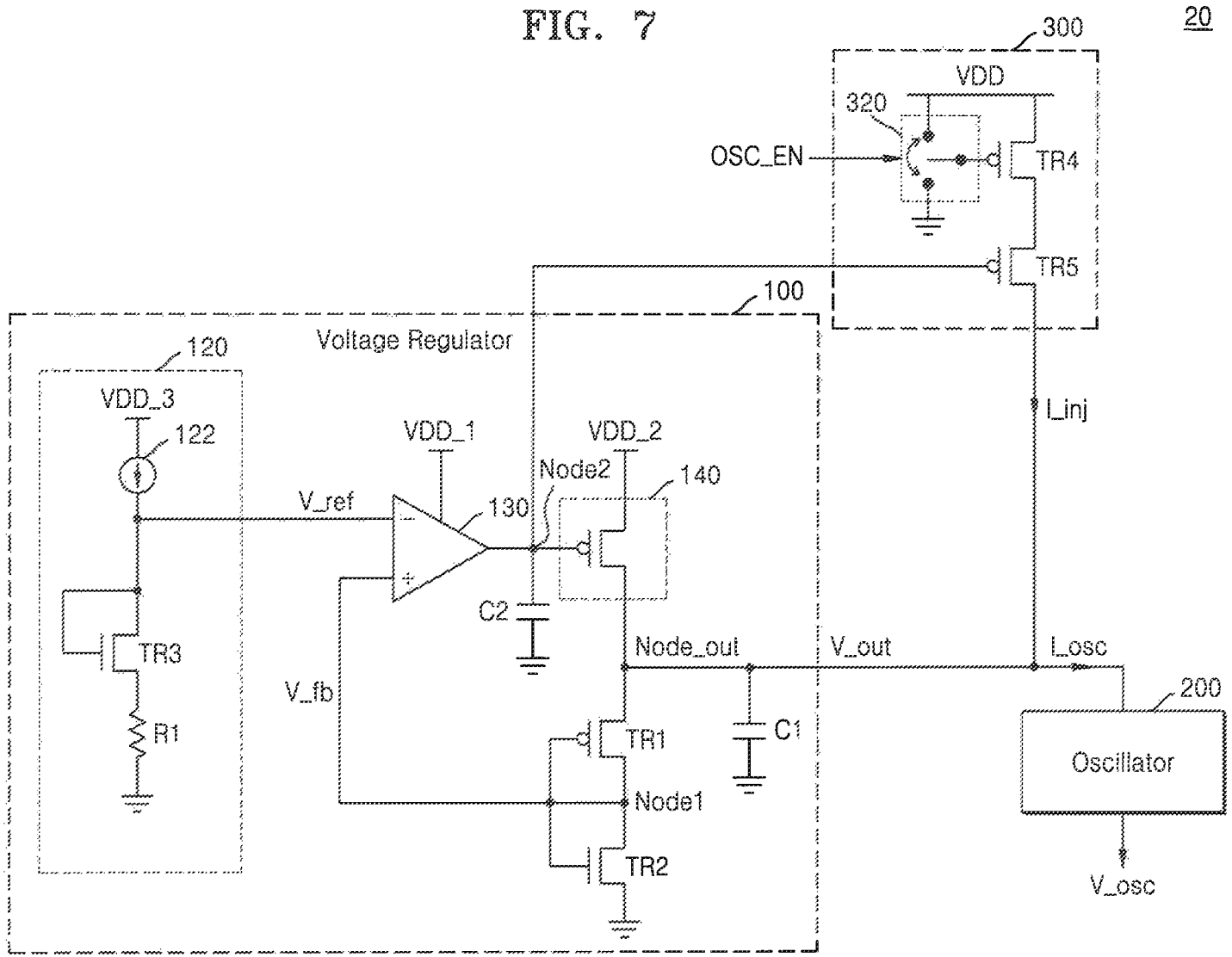
FIG. 7 is a diagram of an integrated circuit according to an exemplary embodiment of the inventive concept.

FIG. 7 is a diagram of an integrated circuit 20 according to an exemplary embodiment of the inventive concept. The integrated circuit 20 may include the voltage regulator 100, the oscillator 200, and the current injection circuit 300. A duplicated description of elements of the integrated circuit 20 of FIG. 7, which are the same as those described for FIG. 1, is omitted.

The reference voltage generator 120 of the voltage regulator 100 may generate the reference voltage V_ref based on the voltage drop due to the third transistor TR3 and the resistor R1 and output the generated reference voltage V_ref as an input to the first terminal of the operational amplifier 130. The second terminal of the operational amplifier 130 may be electrically connected to the first node Node1 between the first transistor TR1 and the second transistor TR2. Although the voltage regulator 100 in FIG. 7 is illustrated as having the same structure as the voltage regulator 100 of FIG. 6A, this is merely exemplary. In another exemplary embodiment of the inventive concept, the voltage regulator 100 in FIG. 7 may have the same structure as the voltage regulator 100 of FIG. 6B.

The voltage regulator 100 may further include a capacitor C2 connected between a second node Node2, which is an electrical node of the output terminal of the operational amplifier 130, and the ground node.

The current injection circuit 300 may include a switching element 320, a fourth transistor TR4, and a fifth transistor TR5.

The switching element 320 may selectively connect a gate of the fourth transistor TR4 to a driving voltage node thereof or the ground node based on the oscillation enable signal OSC_EN. For example, when the oscillation enable signal OSC_EN has the first logic level (for example, '1'), the switching element 320 may connect the gate of the fourth transistor TR4 to the driving voltage node thereof to turn on the fourth transistor TR4. In other words, VDD may be connected to the gate of the fourth driving transistor TR4. Thus, in the oscillation period of the oscillator 200, the switching element 320 may turn on the fourth transistor TR4 and may form an electrical path sequentially connecting the driving voltage node, the fourth transistor TR4, and the fifth transistor TR5. However, when the oscillation enable signal OSC_EN has a second logic level (for example, '0'), the switching element 320 may connect the gate of the fourth transistor TR4 to the ground node to turn off the fourth transistor TR4.

The fourth transistor TR4 may be connected between the driving voltage node and the fifth transistor TR5, and may be driven by the switching element 320. In an exemplary embodiment of the inventive concept, the fourth transistor TR4 may be a p-type MOSFET.

One of a source and a drain of the fifth transistor TR5 may be electrically connected to the fourth transistor TR4, and the other one may be electrically connected to the output node Node_out of the voltage regulator 100. The gate of the fifth transistor TR5 may be electrically connected to a gate of the pass transistor 140 of the voltage regulator 100. In other words, the gate of the fifth transistor TR5 may be connected to the second node Node2 inside the voltage regulator 100. The current injection circuit 300 may generate the injection current I_inj, which is used as the oscillation current I_osc required by the oscillator 200, by driving the fifth transistor TR5, in the oscillation period, with a voltage of the second node Node2 in the voltage regulator 100. The fifth transistor TR5 may facilitate the oscillation current I_osc to flow to the oscillator 200 by forming the injection current I_inj.

In the integrated circuit 20 according to an exemplary embodiment of the inventive concept, the current injection circuit 300 may provide the oscillation current I_osc required by the oscillator 200 to prevent the capacitor C1 in the voltage regulator 100 from discharging, and thus, an inadvertent reduction in the level of the output voltage V_out may be prevented. As a result, the reliability of the integrated circuit 20 may be increased.

Figure 8:
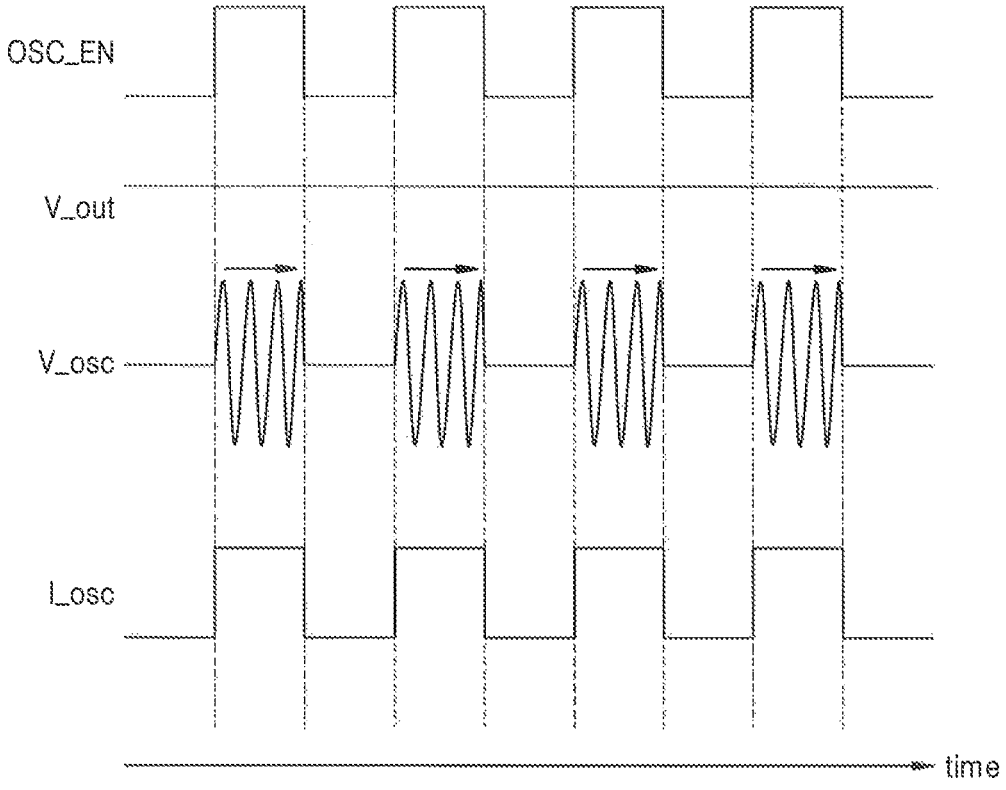
FIG. 8 illustrates timing diagrams of voltages and current due to an integrated circuit of FIG. 7.

FIG. 8 illustrates timing diagrams of voltages and current due to the integrated circuit 20 of FIG. 7, according to an exemplary embodiment of the inventive concept. FIG. 8 is explained with a focus on differences from FIG. 2B. FIG. 8 will be described with reference to FIG. 7.

In the oscillation period in which the oscillation enable signal OSC_EN has the first logic level (e.g., a high level), the oscillation current I_osc may be provided by the current injection circuit 300. Since the oscillation current I_osc is provided by the current injection circuit 300 in the oscillation period, the capacitor C1 may not be discharged. Accordingly, the voltage level of the output voltage V_out may be maintained constant. As the voltage level of the output voltage V_out is maintained constant, the voltage level of the oscillation voltage V_osc may be maintained constant, and a frequency of the oscillation voltage V_osc may also be maintained stable.

In the integrated circuit 20 according to an exemplary embodiment of the inventive concept, the current injection circuit 300 may provide the oscillation current I_osc required by the oscillator 200 to prevent the capacitor C1 in the voltage regulator 100 from discharging, and thus, an inadvertent reduction in the level of the output voltage V_out may be prevented. As a result, the reliability of the integrated circuit 20 may be increased.

Figure 9:
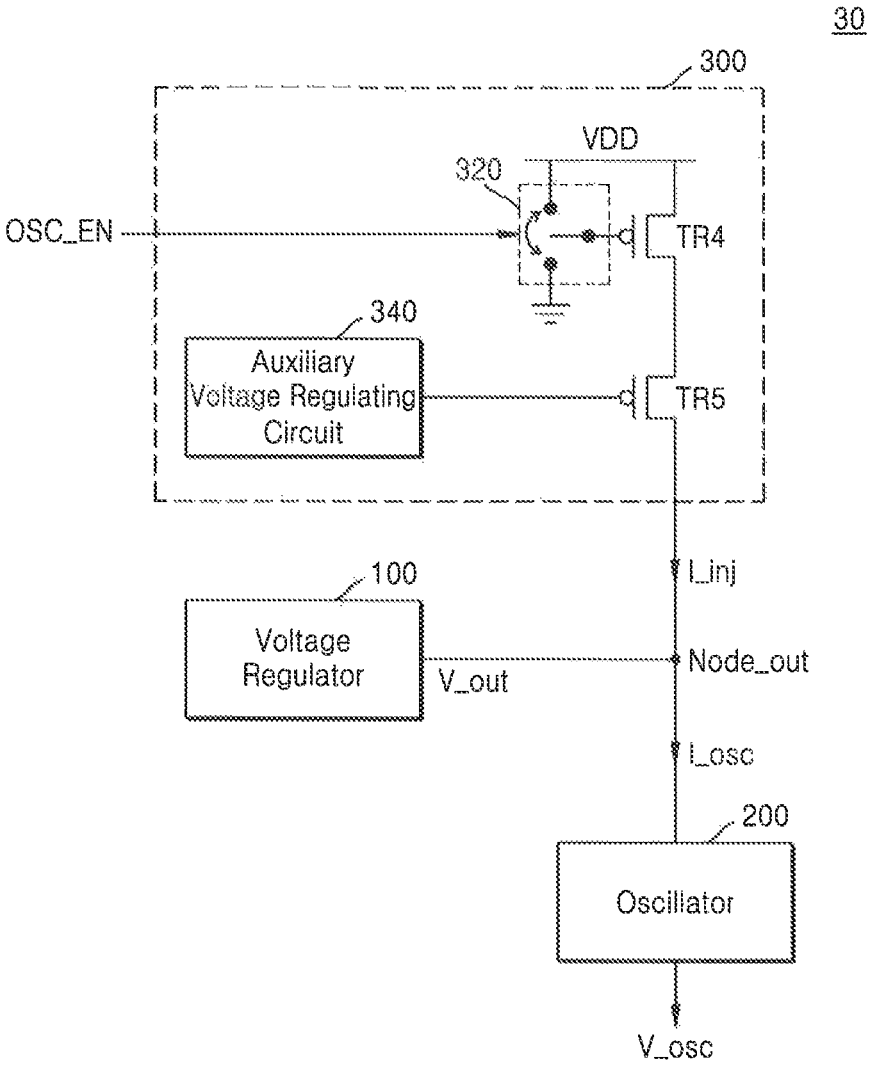
FIG. 9 is a diagram of an integrated circuit according to an exemplary embodiment of the inventive concept.

FIG. 9 is a diagram of an integrated circuit 30 according to an exemplary embodiment of the inventive concept. The integrated circuit 30 may include the voltage regulator 100, the oscillator 200, and the current injection circuit 300. A description of elements of the integrated circuit 30 of FIG. 9, which are the same as described for FIG. 1, is omitted.

The current injection circuit 300 may include the switching element 320, an auxiliary voltage regulating circuit 340, the fourth transistor TR4, and the fifth transistor TR5.

The switching element 320 may selectively electrically connect the gate of the fourth transistor TR4 to the driving voltage node thereof (e.g., VDD) or the ground node based on the oscillation enable signal OSC_EN. In other words, the switching element 320 may selectively turn on the fourth transistor TR4 based on the oscillation enable signal OSC_EN.

The auxiliary voltage regulating circuit 340 may be connected to the gate of the fifth transistor TR5 to drive the fifth transistor TR5. In an exemplary embodiment of the inventive concept, the auxiliary voltage regulating circuit 340 may include circuit components included in the voltage regulator 100. However, in an exemplary embodiment of the inventive concept, a pass transistor included in the auxiliary voltage regulating circuit 340 may be smaller in size than the pass transistor 140 included in the voltage regulator 100. Therefore, a temperature characteristic of a current source of a reference voltage generator included in the auxiliary voltage regulating circuit 340 may be different from the temperature characteristic of the current source 122 of the reference voltage generator 120 included in the voltage regulator 100. The auxiliary voltage regulating circuit 340, which is similarly configured like the voltage regulator 100, may drive the fifth transistor TR5, and thus, the fifth transistor TR5 may stably generate the injection current I_inj required by the oscillator 200. Below, the auxiliary voltage regulating circuit 340 is described in more detail with reference to FIG. 10.

Figure 10:
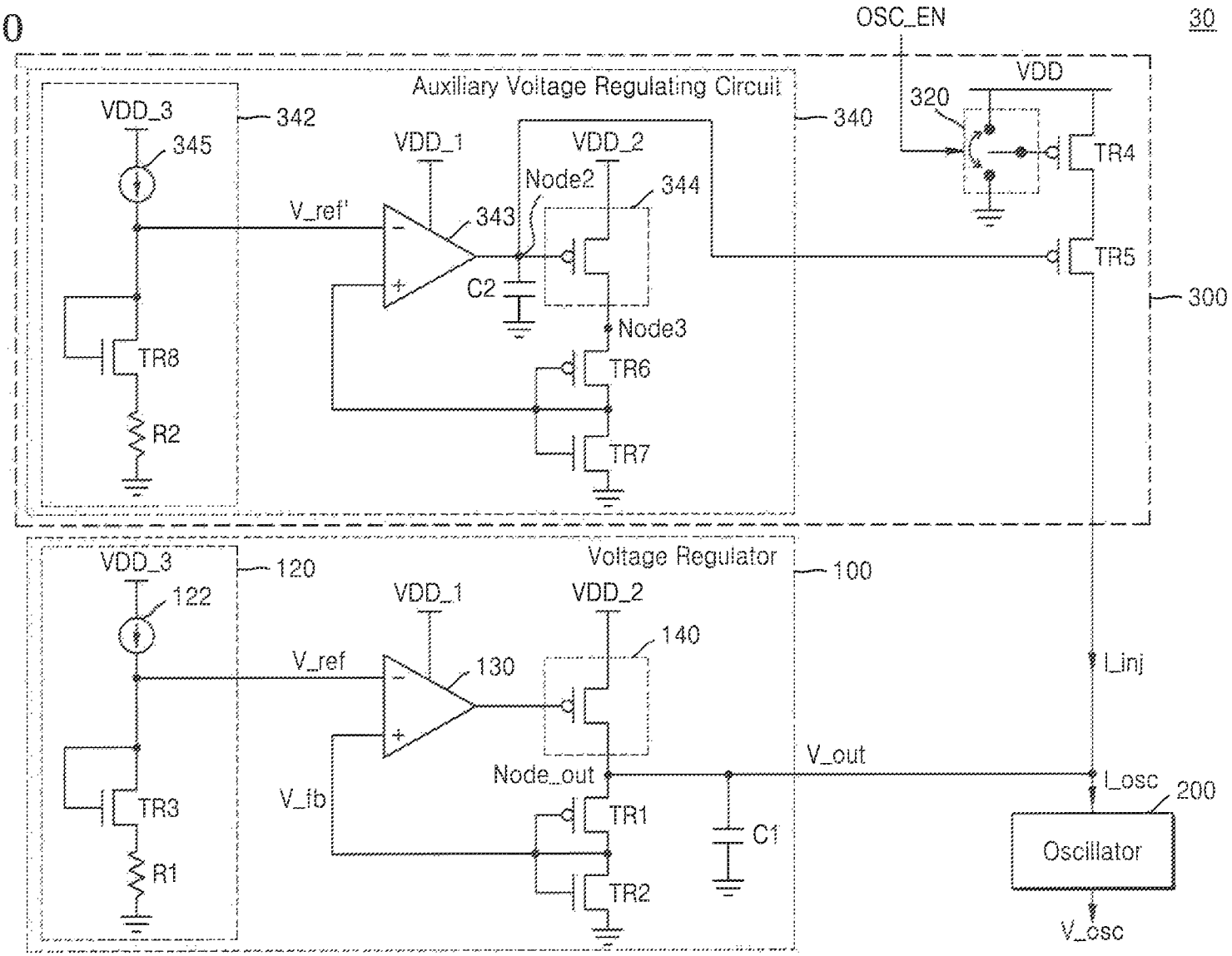
FIG. 10 is a diagram of an integrated circuit according to an exemplary embodiment of the inventive concept.

FIG. 10 is a diagram of the integrated circuit 30 according to an exemplary embodiment of the inventive concept. A duplicate description of elements of the integrated circuit 30 of FIG. 10, which are the same as those described for FIG. 9, is omitted.

The voltage regulator 100 may include the reference voltage generator 120, the operational amplifier 130, the pass transistor 140, the first transistor TR1, and the second transistor TR2. Although the voltage regulator 100 in FIG. 10 is illustrated as having the same structure as the voltage regulator 100 of FIG. 6A, this is merely exemplary. In another exemplary embodiment of the inventive concept, the voltage regulator 100 in FIG. 10 may have the same structure as the voltage regulator 100 of FIG. 6B.

The auxiliary voltage regulating circuit 340 may include the components included in the voltage regulator 100. The auxiliary voltage regulating circuit 340 may include a reference voltage generator 342, an operational amplifier 343, a pass transistor 344, a sixth transistor TR6, and a seventh transistor TR7. A structure of the auxiliary voltage regulating circuit 340 may also be similar to the voltage regulator 100 of FIG. 6B.

Figure 12A:
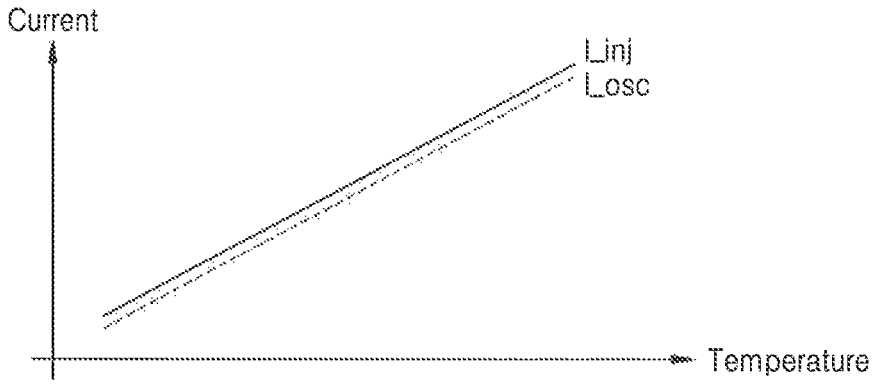
FIGS. 12A and 12B are a current graph according to temperature and a voltage/current graph according to time, respectively, according to an exemplary embodiment of the inventive concept.
Figure 12B:
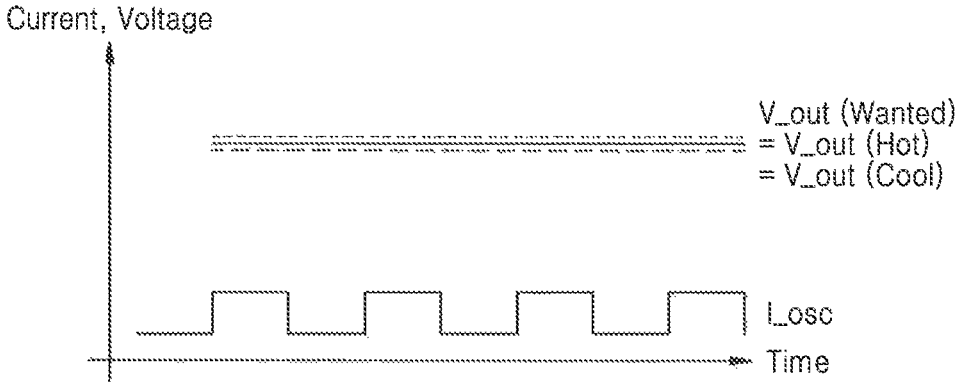

The reference voltage generator 342 of the auxiliary voltage regulating circuit 340 may include a current source 345, an eighth transistor TR8, and a resistor R2. The eighth transistor TR8 and the resistor R2 may be connected in series between a first terminal of the operational amplifier 343 of the auxiliary voltage regulating circuit 340 and a ground node. The eighth transistor TR8 may be diode connected and may be a transistor of the same type as the second transistor TR2 and the third transistor TR3. In an exemplary embodiment of the inventive concept, the current source 345 of the auxiliary voltage regulating circuit 340 may be the PTAT current source having a characteristic in which current is proportional to the absolute temperature. In addition, in an exemplary embodiment of the inventive concept, a temperature slope characteristic of the current source 345 of the auxiliary voltage regulating circuit 340 may be different from the temperature slope characteristic of the current source 122 of the voltage regulator 100. Referring to FIGS. 12A and 12B, a good result may be obtained by having the temperature slope characteristic of the current source 345 of the auxiliary voltage regulating circuit 340 and the temperature slope characteristic of the current source 122 of the voltage regulator 100 different from each other.

The operational amplifier 343 of the auxiliary voltage regulating circuit 340 may amplify a difference between a reference voltage V_ref input to a first terminal of the operational amplifier 343 by the reference voltage generator 342 of the auxiliary voltage regulating circuit 340 and a feedback voltage from a node between the sixth transistor TR6 and the seventh transistor TR7. An output of the operational amplifier 343 of the auxiliary voltage regulating circuit 340 may drive the pass transistor 344 of the auxiliary voltage regulating circuit 340. In an exemplary embodiment of the inventive concept, the pass transistor 344 may be a p-type MOSFET. In an exemplary embodiment of the inventive concept, the pass transistor 344 of the auxiliary voltage regulating circuit 340 may be smaller in size than the fifth transistor TR5. In addition, the pass transistor 344 of the auxiliary voltage regulating circuit 340 may be smaller in size than the pass transistor 140 of the voltage regulator 100. By making the size of the pass transistor 344 of the auxiliary voltage regulating circuit 340 smaller than that of the pass transistor 140 of the voltage regulator 100, electrical noise of the injection current I_inj may be reduced.

The sixth transistor TR6 may be a transistor of the same type as the first transistor TR1, and the seventh transistor TR7 may be a transistor of the same type as the second transistor TR2 and the third transistor TR3.

The capacitor C2 may be connected between the second node Node2 connected to the output terminal of the operational amplifier 343 of the auxiliary voltage regulating circuit 340 and the ground node. In addition, the second node Node2 may be connected to the gate of the fifth transistor TR5, and the voltage of the second node Node2 may drive the fifth transistor TR5.

The auxiliary voltage regulating circuit 340, which drives the fifth transistor TR5, may have components similar to the voltage regulator 100 so that the injection current I_inj has the same characteristic as the voltage regulator 100 even if there is a process variation, and thus, a stable oscillation current I_osc may be formed.

Figure 11A:
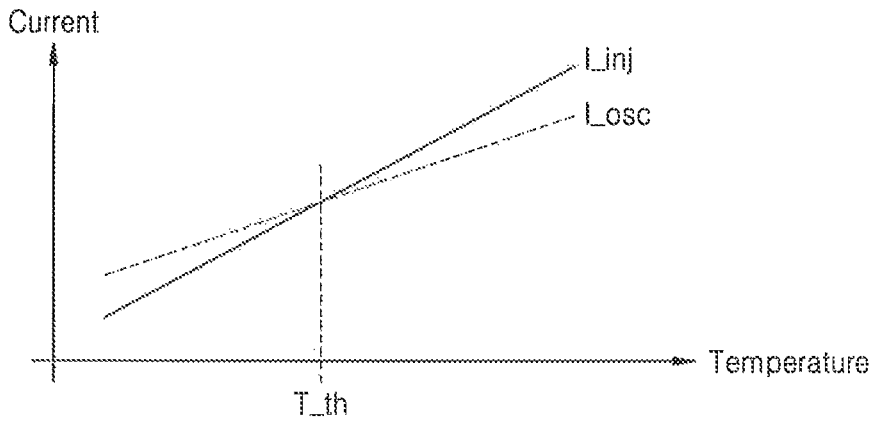
FIGS. 11A and 11B are a current graph according to temperature and a voltage/current graph according to time, respectively, according to an exemplary embodiment of the inventive concept.
Figure 11B:
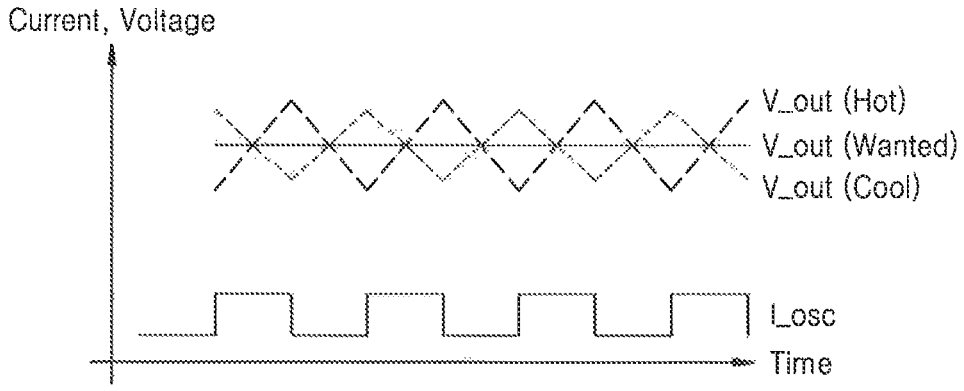

FIGS. 11A and 11B are a current graph according to temperature and a voltage/current graph according to time, respectively, according to an exemplary embodiment of the inventive concept. FIGS. 11A and 11B are graphs explaining the case where the temperature slope characteristic of the current source 122 of the voltage regulator 100 and the temperature slope characteristic of the current source 345 of the auxiliary voltage regulating circuit 340 are the same in the integrated circuit 30 of FIG. 10. FIGS. 11A and 11B are described together with reference to FIG. 10.

Referring to FIG. 11A, when the temperature slope characteristic of the current source 122 of the voltage regulator 100 is equal to the temperature slope characteristic of the current source 345 of the auxiliary voltage regulating circuit 340, due to a difference in partial circuit characteristics of the voltage regulator 100 and the auxiliary voltage regulating circuit 340, the temperature characteristics of the injection current I_inj generated by the current injection circuit 300 and the oscillation current I_osc flowing through the oscillator 200 may be different from each other. As a non-limiting example, the oscillation current I_osc may be greater than the injection current I_inj at a temperature lower than a threshold temperature T_th, and the oscillation current I_osc may be less than the injection current I_inj at a temperature higher than the threshold temperature T_th. Depending on an integrated circuit design, contrary to this case, the injection current I_inj may be greater than the oscillation current I_osc at a temperature lower than a threshold temperature T_th, and the injection current I_inj may be less than the oscillation current I_osc at a temperature higher than the threshold temperature T_th.

Referring to FIG. 11B, when the injection current I_inj and the oscillation current I_osc have temperature slope characteristics as illustrated in FIG. 11A, and when a ambient temperature is lower than the threshold temperature T_th, since in the oscillation period, the oscillation current I_osc is greater than the injection current I_inj, the discharge of the capacitor C1 may occur and the voltage level of the output voltage V_out may be reduced.

When the ambient temperature is greater than the threshold temperature T_th, since in the oscillation period, the oscillation current I_osc is less than the injection current I_inj, a certain amount of current may be injected into the capacitor C1, and thus, the voltage level of the output voltage V_out may be increased.

In other words, when the temperature slope characteristic of the current source 122 of the voltage regulator 100 and the temperature slope characteristic of the current source 345 of the auxiliary voltage regulating circuit 340 are equal, a time-dependent graph according to the temperature variation may exhibit an unstable shape that is different from a required output voltage.

FIGS. 12A and 12B are a current graph according to temperature and a voltage/current graph according to time, respectively, according to an exemplary embodiment of the inventive concept. FIGS. 12A and 12B are graphs explaining the case where the temperature slope characteristic of the current source 122 of the voltage regulator 100 and the temperature slope characteristic of the current source 345 of the auxiliary voltage regulating circuit 340 are different from each other in the integrated circuit 30 of FIG. 10. FIGS. 12A and 12B are described together with reference to FIG. 10.

Referring to FIG. 12A, when the temperature slope characteristic of the current source 122 of the voltage regulator 100 and the temperature slope characteristic of the current source 345 of the auxiliary voltage regulating circuit 340 are different from each other, e.g., when the temperature characteristics are designed to reflect a certain circuit characteristic difference between the voltage regulator 100 and the auxiliary voltage regulating circuit 340, the temperature slope characteristics of the injection current I_inj generated by the current injection circuit 300 and the oscillation current I_osc flowing through the oscillator 200 may be the same.

Referring to FIG. 12B, in the case where the temperature slope characteristics of the injection current I_inj and the oscillation current I_osc are the same, it can be seen that the output voltage V_out may be maintained at a constant voltage level even when the current temperature changes to a low temperature or a high temperature.

In the integrated circuit 30 according to an exemplary embodiment of the inventive concept, by designing the temperature slope characteristic of the current source 122 of the voltage regulator 100 and the temperature slope characteristic of the current source 345 of the auxiliary voltage regulating circuit 340 to be different from each other, the adaptability of the integrated circuit 30 to the temperature variation may be increased and the reliability of the integrated circuit 30 may be increased.

Figure 13:
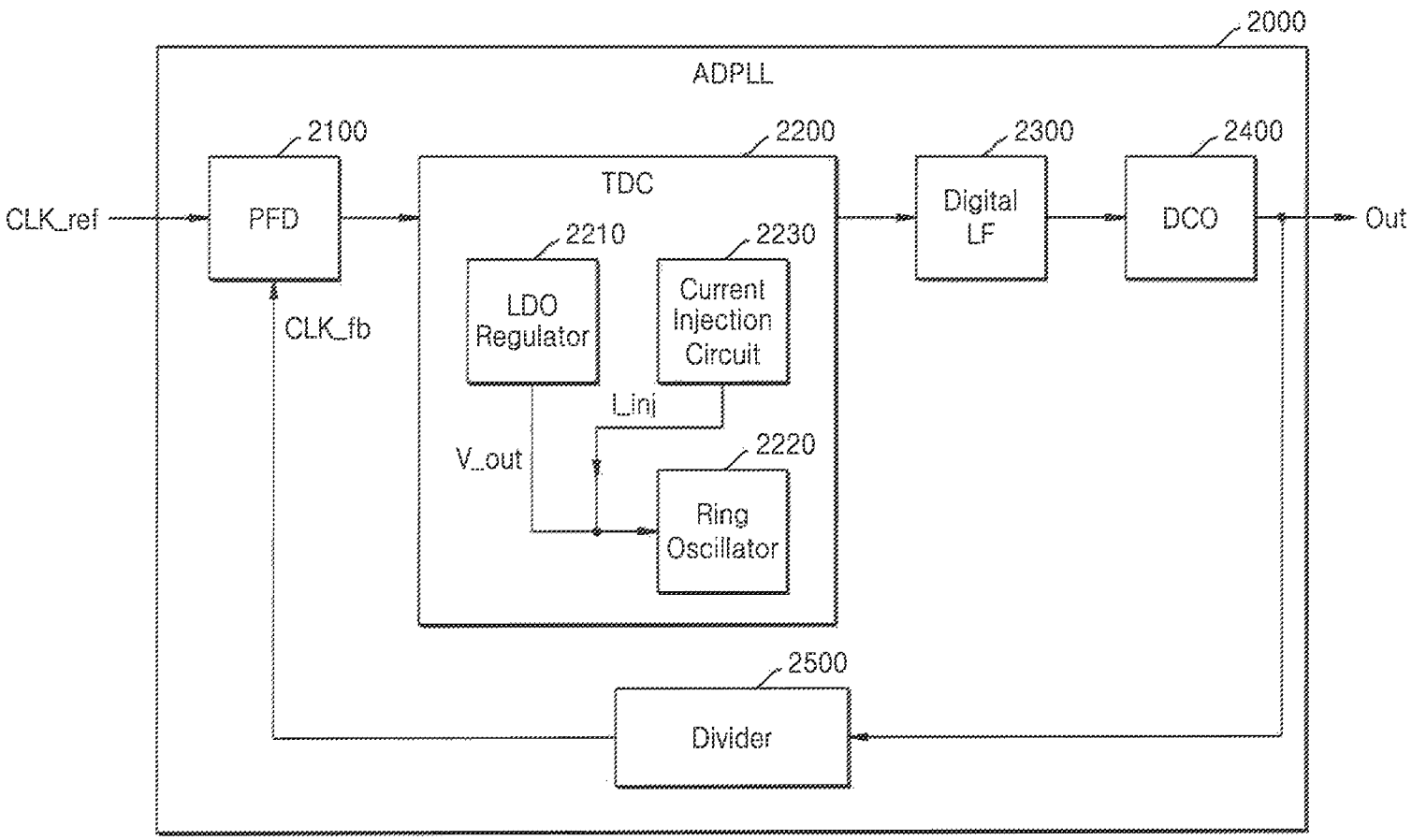
FIG. 13 is a diagram of an all digital phase locked loop according to an exemplary embodiment of the inventive concept.

FIG. 13 is a diagram of an ADPLL 2000 according to an exemplary embodiment of the inventive concept. The ADPLL 2000 include a phase frequency detector (PFD) 2100, a TDC 2200, a digital loop filter (LF) 2300, a digitally controlled oscillator (DCO) 2400, and a frequency divider 2500. The ADPLL 2000 may further include other components as needed. In addition, the ADPLL 2000 may include other components that perform the same function as those illustrated in FIG. 13 except for the TDC 2200. The ADPLL 2000 may be included in any electronic system or electronic device that includes the TDC 2200 having a ring oscillator 2220. For example, the ADPLL 2000 may be included in a radio frequency integrated circuit (RFIC) system.

The PFD 2100 may provide the TDC 2200 with a signal indicating a phase difference between a feedback clock CLK_fb provided from the frequency divider 2500 and a reference clock CLK_ref.

The TDC 2200 may convert time information corresponding to the phase difference into a digital signal based on the phase difference signal provided from the PFD 2100. The TDC 2200 may include a low drop-out (LDO) regulator 2210, the ring oscillator 2220, and a current injection circuit 2230. The TDC 2200 may convert the time information corresponding to the phase difference into a digital signal by counting the number of oscillations of an oscillation voltage of a constant frequency output from the ring oscillator 2220 while the phase difference signal is being input. A consistency of a frequency of the oscillation voltage generated by the ring oscillator 2220 may be regarded as one of the indices representing the reliability of the TDC 2200. To keep the frequency of the oscillation voltage generated by the ring oscillator 2220 constant, the output voltage V_out provided by the LDO regulator 2210 may be required to be kept constant in the oscillation period. To accomplish this, the current injection circuit 2230 may, in the oscillation period, provide the oscillation current I_inj to the ring oscillator 2220. The TDC 2200 in FIG. 13 may be implemented in the same or similar manner as the integrated circuits described with reference to FIGS. 1, and 5 through 12B. For example, the LDO regulator 2210 may correspond to the voltage regulator 100 in FIG. 1, and FIGS. 5 through 12B, the ring oscillator 2220 may correspond to the oscillator 200 in FIG. 1, and FIGS. 5 through 12B, and the current injection circuit 2230 may correspond to the current injection circuit 300 in FIG. 1, and FIGS. 5 through 12B.

The digital LF 2300 may perform a filtering operation on the digital signal provided from the TDC 2200 by using a digital signal processing method and provide a result of the filtering operation to the DCO 2400. The DCO 2400 may oscillate an output signal Out by using the digital signal processing method based on the signal provided from the digital LF 2300.

The TDC 2200 implemented by using an integrated circuit according to an exemplary embodiment of the inventive concept may enhance a linear characteristic with the injection current I_inj provided by the current injection circuit 2230, and accordingly, increase the adaptability to variations in PVT. Thus, the reliability of an operation of the ADPLL 2000 may also be increased.

Figure 14:
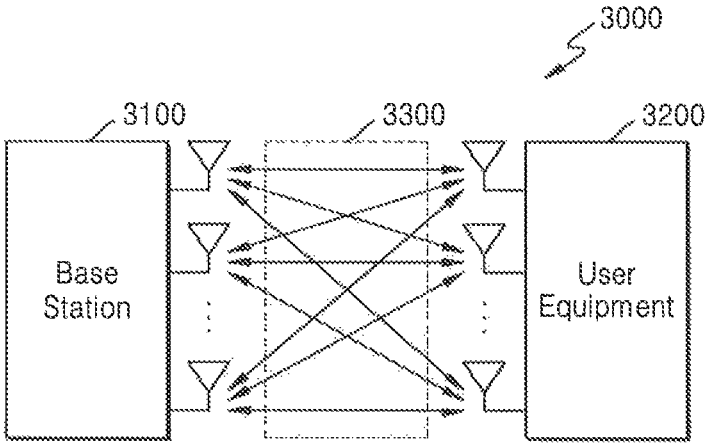
FIG. 14 is a diagram of a wireless communication system according to an exemplary embodiment of the inventive concept.

FIG. 14 is a diagram of a wireless communication system 3000 according to an exemplary embodiment of the inventive concept. FIG. 14 illustrates an example in which a base station 3100 and user equipment 3200 perform wireless communication in the wireless communication system 3000 using a cellular network. The base station 3100 and the user equipment 3200 may include integrated circuits adaptable to the PVT variation or a PLL including the integrated circuits according to exemplary embodiments of the inventive concept described with reference to FIG. 1 and FIGS. 5 through 12B. Accordingly, the base station 3100 and the user equipment 3200 may perform a stable frequency processing on signals to be transceived.

The base station 3100 may be a fixed station that communicates with the user equipment 3200 and/or other base stations. For example, the base station 3100 may include a Node B, an evolved Node B (eNB), a sector, a site, a base transceiver system (BTS), an access point (AP), a relay node, a remote radio head (RRH), a radio unit (RU), a small cell, etc. The user equipment 3200 may be fixed or mobile and may communicate with the base station 3100 to receive data and/or control information. For example, the user equipment 3200 may include terminal equipment, a mobile station (MS), a mobile terminal (MT), a user terminal (UT), a subscriber station (SS), a handheld device, etc. As illustrated in FIG. 14, the base station 3100 and the user equipment 3200 may each include a plurality of antennas and may communicate wirelessly via a multiple input multiple output (MIMO) channel 3300.

While the inventive concept has been particularly shown and described with reference to exemplary embodiments thereof, it will be understood by those of ordinary skill in the art that various modifications may be made thereto without departing from the scope of the inventive concept as defined by the appended claims.

What is claimed:

1. An integrated circuit, comprising:

an oscillator configured to generate an oscillating voltage with a predetermined oscillation frequency in an oscillation period;

a voltage regulator configured to generate an output voltage for driving the oscillator and provide the output voltage to the oscillator; and a current injection circuit configured to provide an oscillation current to the oscillator, in response to an oscillation enable signal in the oscillation period.

2. The integrated circuit of claim 1, wherein the voltage regulator comprises:

a reference voltage generator configured to generate a reference voltage;

an operational amplifier (OP AMP) configured to amplify a difference between the reference voltage and a feedback voltage provided from a first node connected to a first terminal of a first transistor, wherein a second terminal of the first transistor is connected to an output node of the voltage regulator; and a pass transistor configured to output the output voltage to the output node of the voltage regulator in response to an output signal of the OP AMP input to a gate of the pass transistor.

3. The integrated circuit of claim 2, wherein the pass transistor comprises a p-type metal oxide semiconductor field effect transistor (MOSFET).

4. The integrated circuit of claim 2, wherein the voltage regulator further comprises the first transistor and a second transistor connected in series between the output node of the voltage regulator and a ground node, the first transistor and the second transistor each being diode connected, and the feedback voltage is a voltage of the first node that is an electrical node shared by the first transistor and the second transistor.

5. The integrated circuit of claim 2, wherein the reference voltage generator comprises:

a third transistor connected to a second node that is an electrical node configured to provide the reference voltage, wherein the third transistor is diode connected; and a resistor connected between the third transistor and a ground node.

6. The integrated circuit of claim 5, wherein the voltage regulator further comprises:

the first transistor connected to the output node of the voltage regulator, wherein the first transistor is a different type transistor from the third transistor; and a second transistor connected between the first transistor and the ground node and being of an identical type transistor as the third transistor.

7. The integrated circuit of claim 6, wherein the second transistor and the third transistor comprise p-type metal oxide semiconductor field effect transistors (MOSFETs), and the first transistor comprises an n-type MOSFET.

8. The integrated circuit of claim 6, Wherein the second transistor and the third transistor comprise n-type metal oxide semiconductor field effect transistors (MOSFETs), and the first transistor comprises a p-type MOSFET.

9. The integrated circuit of claim 2, wherein the current injection circuit comprises:

a fourth transistor that is selectively turned on in response to the oscillation enable signal; and a fifth transistor having a gate connected to an output terminal of the OP AMP, wherein a first terminal of the fifth transistor is connected to the fourth transistor, and a second terminal of the fifth transistor is connected to the oscillator.

10. The integrated circuit of claim 1, wherein the current injection circuit comprises:

an auxiliary voltage regulating circuit;

a fourth transistor that is selectively turned on in response to the oscillation enable signal; and a fifth transistor configured to receive a gate signal from the auxiliary voltage regulating circuit, the fifth transistor comprising a terminal thereof connected to the fourth transistor.

11. The integrated circuit of claim 10, wherein a size of a pass transistor included in the auxiliary voltage regulating circuit is less than that of a pass transistor included in the voltage regulator.

12. The integrated circuit of claim 10, wherein a size of a pass transistor of the auxiliary voltage regulating circuit is less than that of the fifth transistor.

13. The integrated circuit of claim 10, wherein a current source included in a reference voltage generator of the voltage regulator and a current source included in a reference voltage generator of the auxiliary voltage regulating circuit are proportional to absolute temperature (PTAT) current sources, and a temperature slope characteristic of the current source in the auxiliary voltage regulating circuit is different from that of the current source in the voltage regulator.

14. An integrated circuit, comprising:

an oscillator configured to generate an oscillation voltage in an oscillation period;

a voltage regulator configured to drive the oscillator by providing an output voltage to the oscillator via an output terminal of the voltage regulator; and a current injection circuit connected to the oscillator and the output terminal of the voltage regulator, the current injection circuit being configured to output an oscillation current to the oscillator in the oscillation period, wherein the voltage regulator comprises:

an operational amplifier (OP AMP) configured to amplify a difference between a reference voltage input to a first terminal of the OP AMP and a feedback voltage input to a second terminal of the OP AMP; and a reference voltage generator configured to generate the reference voltage by injecting a current to a transistor and a resistor, the reference voltage generator being connected to the first terminal of the OP AMP.

15. The integrated circuit of claim 14, wherein the voltage regulator further comprises:

a first transistor connected between an output terminal of the OP AMP and the second terminal of the OP AMP, wherein the first transistor is diode connected; and a second transistor connected between the second terminal of the OP AMP and a ground node, wherein the second transistor is a different type transistor from the first transistor, and the second transistor is diode connected, wherein the transistor injected with the current by the reference voltage generator is a third transistor which is connected between the first terminal of the OP AMP and the ground node, wherein third transistor is an identical type transistor as the second transistor.

16. The integrated circuit of claim 15, wherein the second transistor and the third transistor comprise p-type metal oxide semiconductor field effect transistors (MOSFETs), and the first transistor comprises an n-type MOSFET.

17. The integrated circuit of claim 14, wherein the current injection circuit comprises:

a fourth transistor configured to be selectively turned on in response to an oscillation enable signal, wherein the fourth transistor is turned on in the oscillation period; and a fifth transistor connected to the fourth transistor, wherein the fifth transistor receives a gate signal from an auxiliary voltage regulating circuit and provides an injection current to the oscillator in the oscillation period.

18. An integrated circuit configured to supply a constant voltage and a constant current to components connected to each other in an operation period, the integrated circuit comprising:

a voltage regulator configured to output a constant direct current output voltage via an output node connected to the components; and a current injection circuit including a first transistor which is configured to receive a gate voltage signal from an auxiliary voltage regulating circuit, generate an injection current, and output the injection current to the components in the operation period.

19. The integrated circuit of claim 18, wherein the current injection circuit further comprises a second transistor which is turned on in response to an operation enable signal of a first level in the operation period, and the first transistor is connected in series to the second transistor, and in the operation period, the first transistor is configured to output the injection current to the components.

20. The integrated circuit of claim 18, wherein a size of a pass transistor included in the auxiliary voltage regulating circuit is smaller than that of the first transistor, and a temperature slope characteristic of a proportional to absolute temperature (PTAT) current source included in a reference voltage generator of the auxiliary voltage regulating circuit is different from a temperature slope characteristic of a PTAT current source included in a reference voltage generator of the voltage regulator.

* * * * *